US010445991B1

(12) United States Patent
Wong

(10) Patent No.: US 10,445,991 B1
(45) Date of Patent: Oct. 15, 2019

(54) WIRELESS DOORBELL SET

(71) Applicant: Long Wong, Great Neck, NY (US)

(72) Inventor: Long Wong, Great Neck, NY (US)

( * ) Notice: Subject to any disclaimer, the term of this patent is extended or adjusted under 35 U.S.C. 154(b) by 0 days.

(21) Appl. No.: 16/018,204

(22) Filed: Jun. 26, 2018

(51) Int. Cl.
*G08B 3/10* (2006.01)
*G08B 5/22* (2006.01)
*G08B 5/36* (2006.01)

(52) U.S. Cl.
CPC ..... *G08B 3/1058* (2013.01); *G08B 5/228* (2013.01); *G08B 5/36* (2013.01)

(58) Field of Classification Search
CPC ..... G08B 3/1058; G08B 5/228; G08B 5/36
USPC ..... 340/7.58, 7.61, 7.62, 7.63, 12.22, 12.54, 340/12.55, 12.5, 13.24, 13.25, 13.32, 330, 340/539.1, 539.11, 539.14, 693.5
See application file for complete search history.

(56) References Cited

U.S. PATENT DOCUMENTS 4,476,469 A * 10/1984 Lander ..... G07C 9/00111 340/8.1
5,365,214 A * 11/1994 Angott ..... G08B 1/08 340/328
5,576,690 A * 11/1996 Waugh ..... G08B 1/08 340/4.13
5,757,305 A * 5/1998 Xydis ..... G08B 3/10 340/12.5
6,255,951 B1 * 7/2001 De La Huerga ..... A61J 1/035 340/573.1
6,674,364 B1 * 1/2004 Holbrook ..... G08B 21/24 340/539.32
6,946,988 B2 * 9/2005 Edwards ..... G08C 23/04 340/12.52
D800,005 S * 10/2017 Wong ..... D10/118.2
2003/0124993 A1 * 7/2003 Bentley ..... G08B 1/08 455/91
2005/0143029 A1 * 6/2005 Sasaki ..... H04B 1/0346 455/128
2008/0309509 A1 * 12/2008 Ortiz ..... G08B 15/002 340/691.2
2009/0243791 A1 * 10/2009 Partin ..... G07C 9/00944 340/5.2

FOREIGN PATENT DOCUMENTS

GB 2516701 A * 2/2015 ..... H04M 11/025

* cited by examiner

*Primary Examiner* — Edwin C Holloway, III
(74) *Attorney, Agent, or Firm* — John F. Vodopia

(57) ABSTRACT

A wireless doorbell set includes a wearable ringer (transmitter) and a wireless doorbell receiver, which is responsive to a ring signal transmitted to the receiver from the wearable ringer. The wearable ringer is configured with a removable bracket that may be mounted to a wall such that the wearable ringer may be attached to the removable bracket on the wall, to temporarily position the ringer thereon when it is not worn by a user, and to remove and separate the wearable ringer from the wall-mounted bracket when the user wishes to wear the wearable ringer, for example, on a lanyard that may be placed over the user's head. The wireless doorbell receiver receives the ring signal from the wearable ringer and generates a sound, a light signal or both.

15 Claims, 6 Drawing Sheets

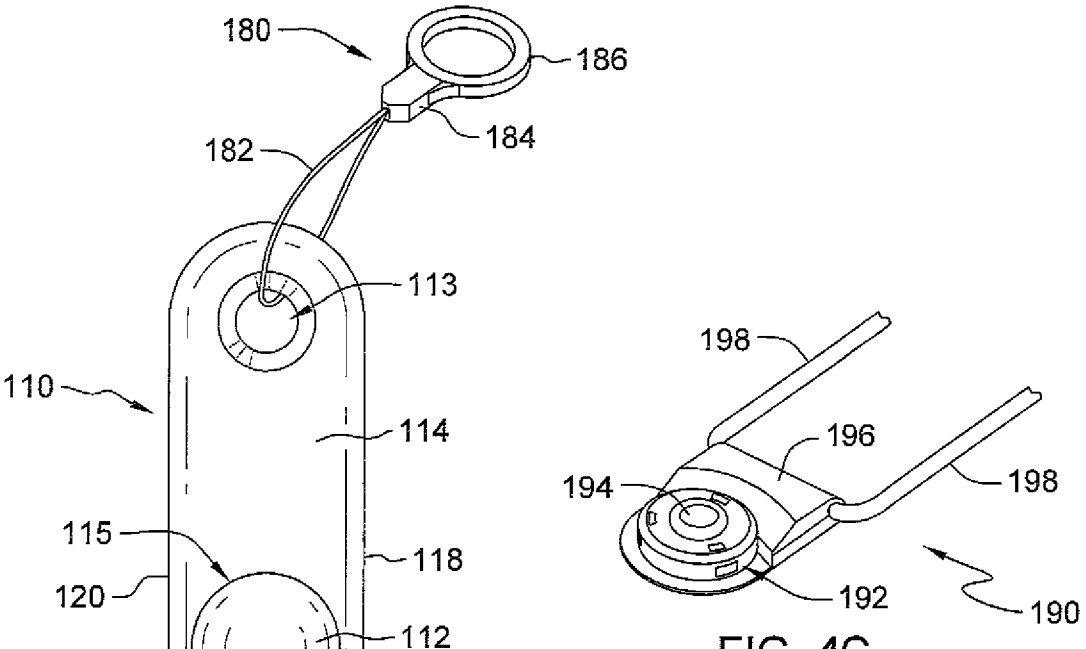
FIG. 4C
FIG. 4B
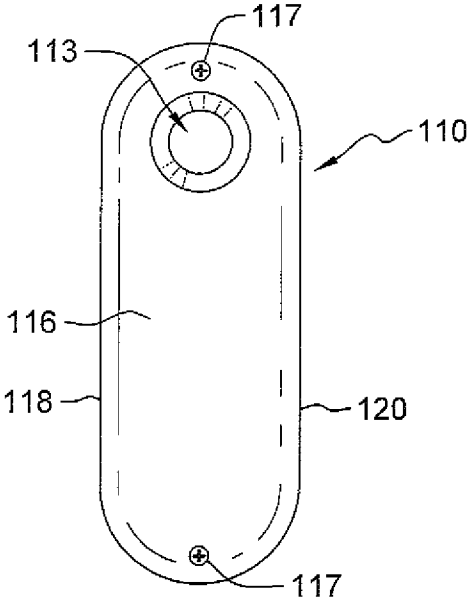
FIG. 4A

WIRELESS DOORBELL SET

BACKGROUND OF THE INVENTION

The invention relates generally to a wireless doorbell set, and more particularly, to a wireless doorbell set that includes a wearable ringer (transmitter) configured with a removable bracket that is mounted to a wall or other surface such that the wearable ringer may be attached to the removable bracket so mounted, to temporarily position the ringer thereon when the wearable ringer is not worn by a user, and to remove and separate the wearable ringer from the mounted bracket when the user wishes to wear the wearable ringer, for example, on a lanyard that may be placed over the user's head, or otherwise hold the ringer. The wireless doorbell set also includes a wireless doorbell receiver that receives a signal from the wearable ringer (transmitter) and generates a sound defined by the signal received.

SUMMARY OF THE INVENTION

The present invention provides a wireless doorbell set that includes a wearable ringer (transmitter) and wireless doorbell receiver, which overcome the shortcomings of the prior art.

In a preferred embodiment, wireless doorbell set includes a wearable ringer (transmitter) configured with a removable bracket that is configured to be mounted to a wall (or other surface) such that the wearable ringer may be attached to the removable bracket as mounted, to temporarily position the wearable ringer thereon when the wearable ringer is not worn by a user, and to remove and separate the wearable ringer from the mounted bracket when the user wishes to wear the wearable ringer, for example, on a lanyard that may be placed over the user's head. The user merely presses an actuator button on the wearable ringer and in response, the wearable ringer generates and transmits a signal to a wireless doorbell receiver. In response to the received signal, the wireless doorbell receiver generates and emits a sound, or a light signal or both, to draw attention to the wireless doorbell receiver and/or user.

In an embodiment, the invention provides a wireless doorbell set. The wireless doorbell set comprises a wearable ringer comprising a ringer housing formed with a front, a back, a top, a bottom, a left and a right side, a push button actuator positioned on the front side of the ringer housing that when pushed by a user generates a wireless ring signal, a wireless doorbell receiver that is configured to receive the wireless ring signal generated by the wearable ringer and to generate a sound signal, a light signal or both in response to receiving the wireless ring signal. A wearable ringer bracket is configured to receive the wearable ringer and a lanyard that is configured to be attachable to and detachable from the wearable ringer. The wearable ringer bracket is mounted on a surface such as an outside or inside wall of the user's home. The wearable ringer is maintained in or attached to the wearable ringer bracket or is attached to the lanyard, rather than the bracket.

Attaching the wearable ringer to the lanyard enables a user to wear the lanyard and wearable ringer about the user's neck and actuate the push button actuator which generates a signal that when received by the wireless doorbell receiver causes the receiver to generate the sound, the light signal or both, as long as the wearable ringer is in a receiving range of the wireless doorbell receiver. For that matter, attaching the wearable ringer to the wearable ringer bracket enables the user to wear the lanyard and wearable ringer with the wearable ringer bracket attached thereto about the user's neck The wearable ringer bracket, when detached from the wearable ringer, is mounted at a stationery position (surface) within a receiving range of the receiver. Moreover, the wearable ringer is attached to the wearable ringer bracket at the mounted stationery position, whereby a user may actuate the push button actuator to cause the wireless doorbell receiver to generate the sound, light signal or both.

In an embodiment, the wearable ringer housing includes substantially parallel grooves arranged along the left and right sides, proximate to the back side, substantially in parallel to a planar surface of the back side. Preferably, the wearable ringer bracket is configured with opposing side flanges that slide into and out of the corresponding grooves on the wearable ringer, to attach the wearable ringer to and detach the wearable ringer from the wearable ringer bracket. The wearable ringer bracket includes a latching mechanism that latches the wearable ringer when the wearable ringer is slid into the wearable ringer bracket to a latching position. For that matter, the latching mechanism includes a release button for unlatching the wearable ringer from its latched position with the wearable ringer bracket.

In an embodiment, the wearable ringer housing includes an opening that extends completely through the wearable ringer, from the front side through to the back side and wherein the lanyard is attachable to and detachable from the wearable ringer via the opening. Preferably, the opening is arranged proximate one end of the wearable ringer housing and the push button actuator is arranged on an opposing end of the wearable ringer housing.

The wearable ringer further comprises an antenna, button battery, a PCB board comprising electronic components including at least one integrated circuit, at least one filter, an LED, at least one triode, a touch switch and a crystal, and the wireless doorbell receiver further comprises a power connector, a speaker, a transformed, a touch switch, an antenna, a PCB board comprising electronic components including at least one integrated circuit, at least one music integrated circuit, at least one chip diodes, at least one triode, at least one rectifier diode, touch switches and an LED. The touch switches control the sound volume and a musical selection for the sound.

DRAWING FIGURES

Further features and advantages of the invention will become apparent from the description of embodiments that follows, with reference to the attached figures, in which:

FIG. 1 depicts a wireless doorbell set of the invention;

FIG. 2A presents a perspective view of a wearable wireless ringer of the inventive wireless doorbell set with the wearable ringer bracket attached;

FIG. 2B presents a perspective view of the wearable ringer bracket separated from the wearable ringer;

FIG. 2C presents a side perspective view of the wearable ringer to highlight grooves for receiving parts of the wearable ringer bracket;

Figure 5B:
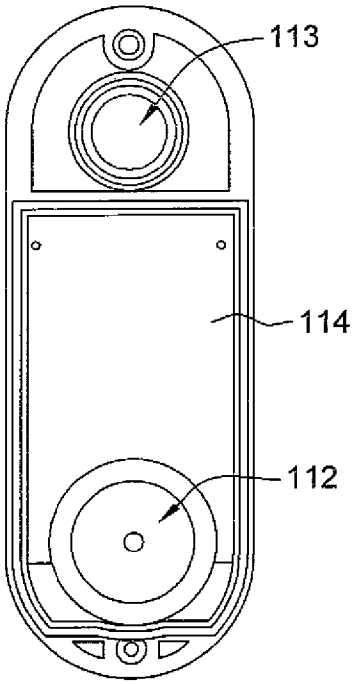
Figure 5A:
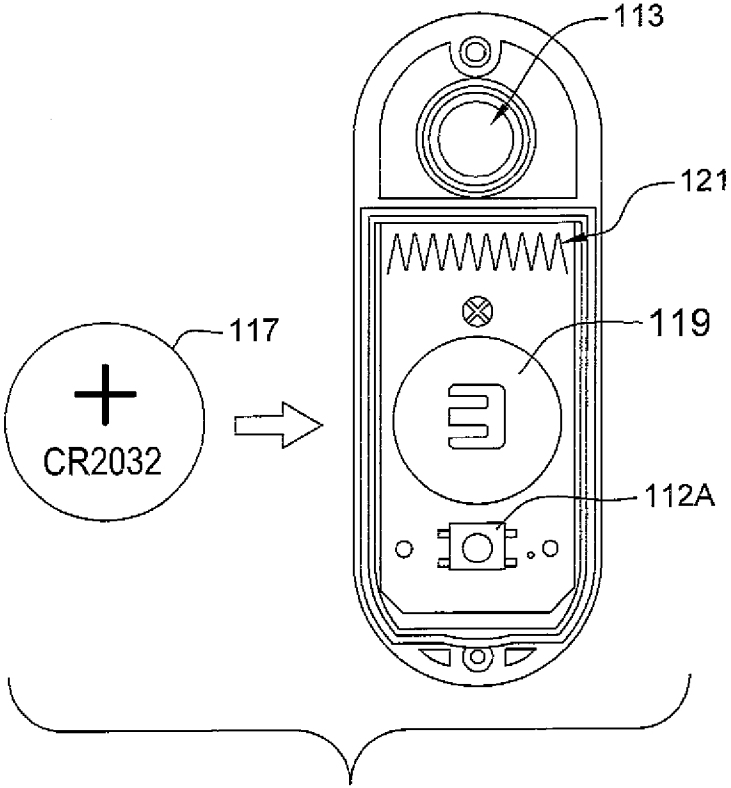

FIG. 4A presents a back view of the wearable wireless ringer depicted in FIG. 3, with the wearable ringer bracket removed;

FIG. 4B presents a front view of the wearable ringer depicted in FIG. 3, with the wearable ringer bracket attached and with a removable lanyard ring;

FIG. 4C depicts a lanyard and attachment mechanism for attaching the lanyard to the removable lanyard ring of FIG. 4B;

FIG. 5A presents a front view of the wearable ringer depicted in FIG. 3, with the wearable ringer bracket removed and the front cover removed; and FIG. 5B presents a front view of the wearable ringer.

DETAILED DESCRIPTION OF THE INVENTION

The following is a detailed description of example embodiments of the invention depicted in the accompanying drawings. The example embodiments are in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
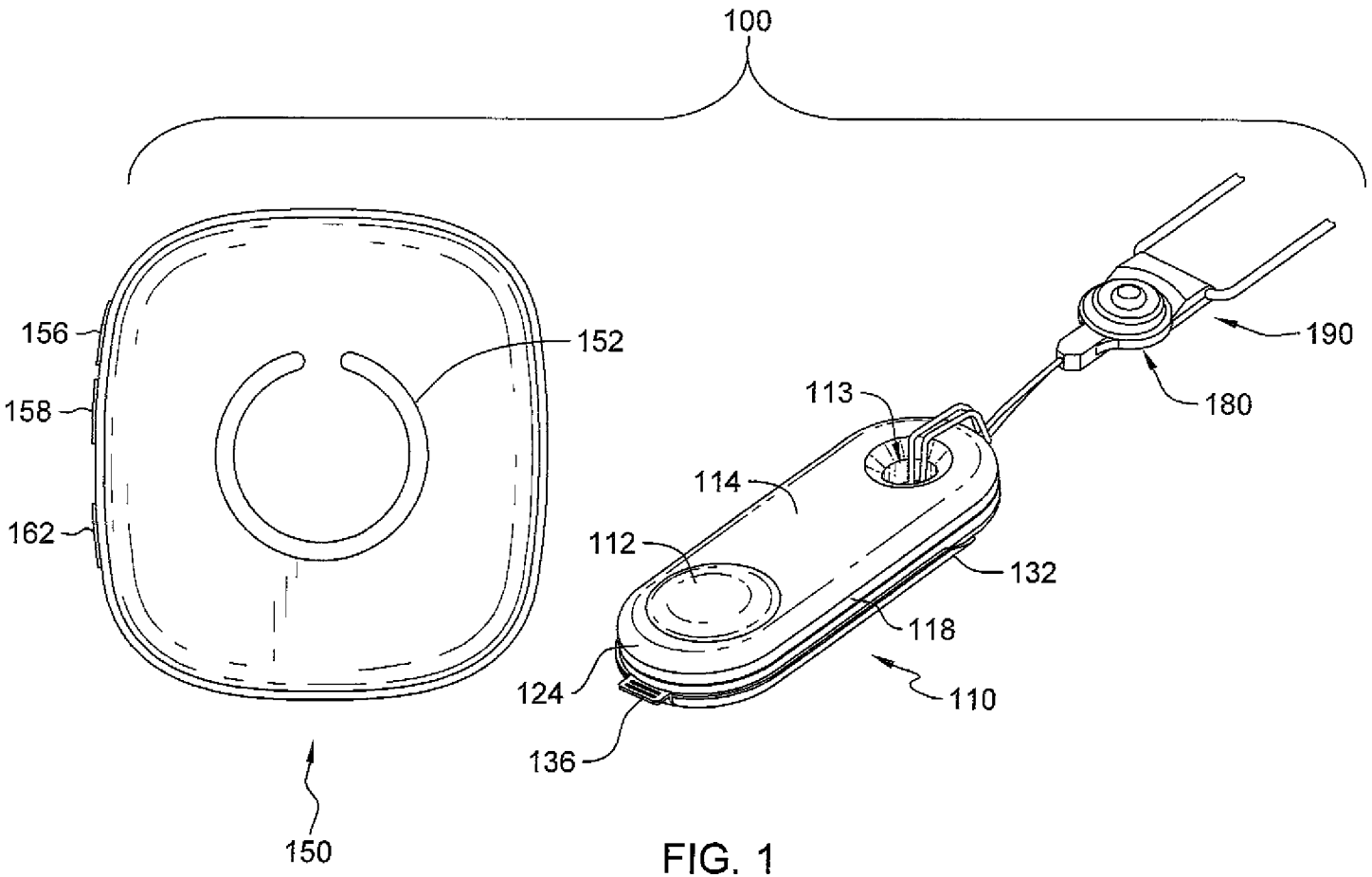

FIG. 1 depicts a wireless doorbell set 100 of the invention. The wireless doorbell set 100 comprises a wearable ringer 110, a wireless doorbell receiver 150, a removable lanyard ring 180 removably attached (via a cord or cable) to the wearable ringer 110 and a lanyard connection mechanism 190 that is detachably attached to the removable lanyard ring 180. The wearable ringer 110 (see also FIG. 2A) comprises a housing that may be separated into front and back parts, that secured together to form the complete housing see FIG. 4A). When the front and back parts of the wearable ringer are connected, the wearable ringer housing includes a front side 114, a back side 116, a left side 118, a right side 120, a top side 122 and a bottom side 124. The wearable ringer includes, in its front side 114, a ringer actuator 112, and a through-hole 113 extending between the front 114 and back 116 sides.

Figure 2A:
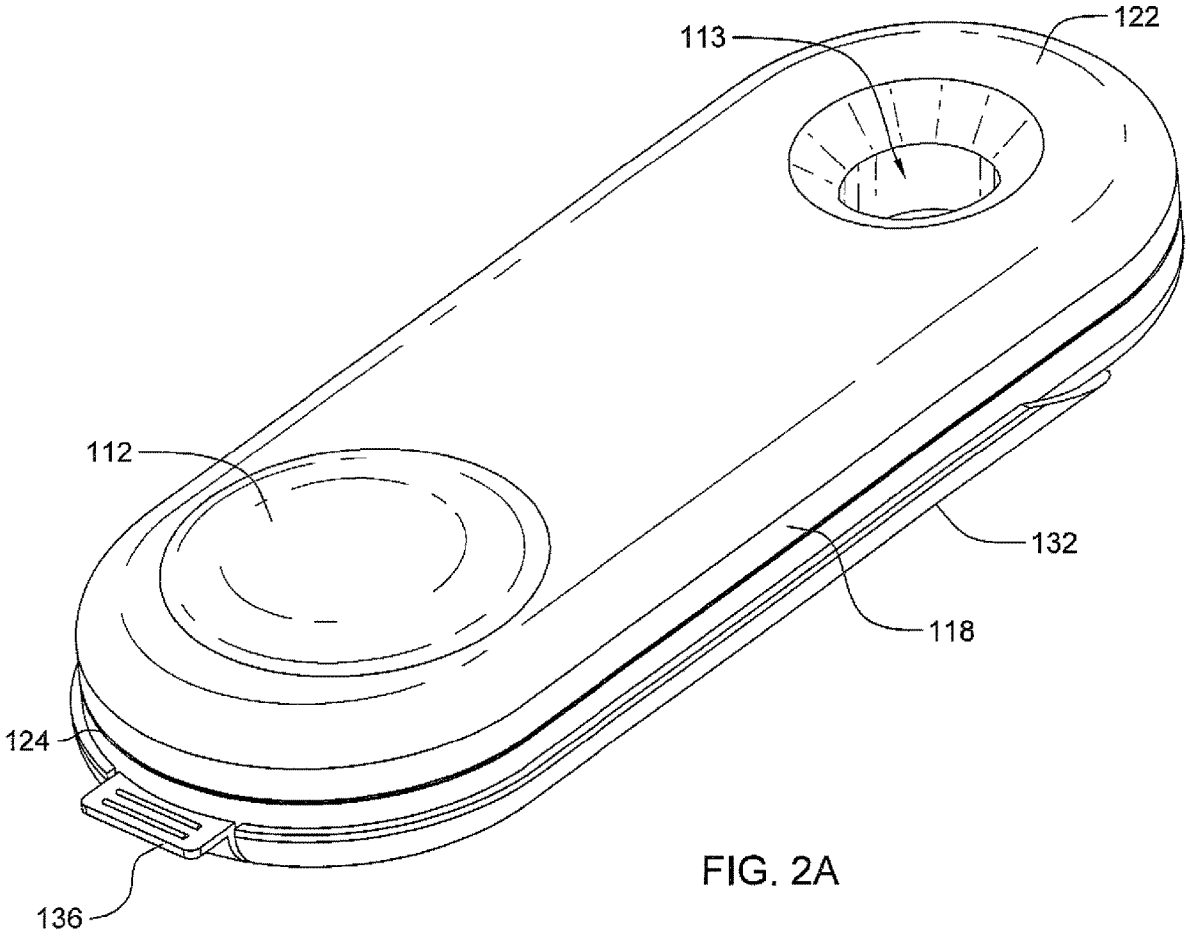
Figure 2B:
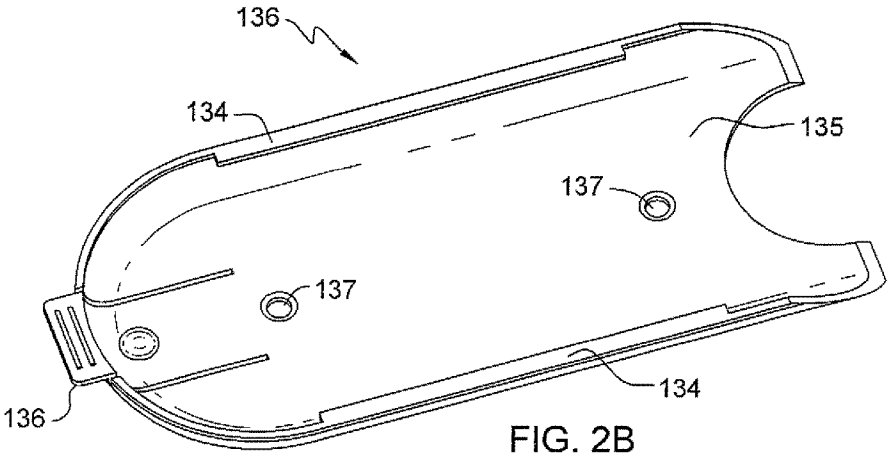

FIGS. 2A and 2B highlight an embodiment of the wearable ringer bracket 132 attached to the back side 116 of the wearable ringer 110. The wearable ringer bracket 132 is detachable from the back side 116 of the wearable ringer. The wearable ringer bracket 132 comprises a substantially flat plate 135 with mounting holes 137. Substantially parallel tongues or flanges 134 extend from side edges of the plate 135 and turn in towards the center. These tongues or flanges 134 are included to slide into (and out of) grooves 126 included in the lower part of left and right sides 118, 120 of the wearable ringer (housing) 110, to attach/detach the two respective parts.

Figure 2C:
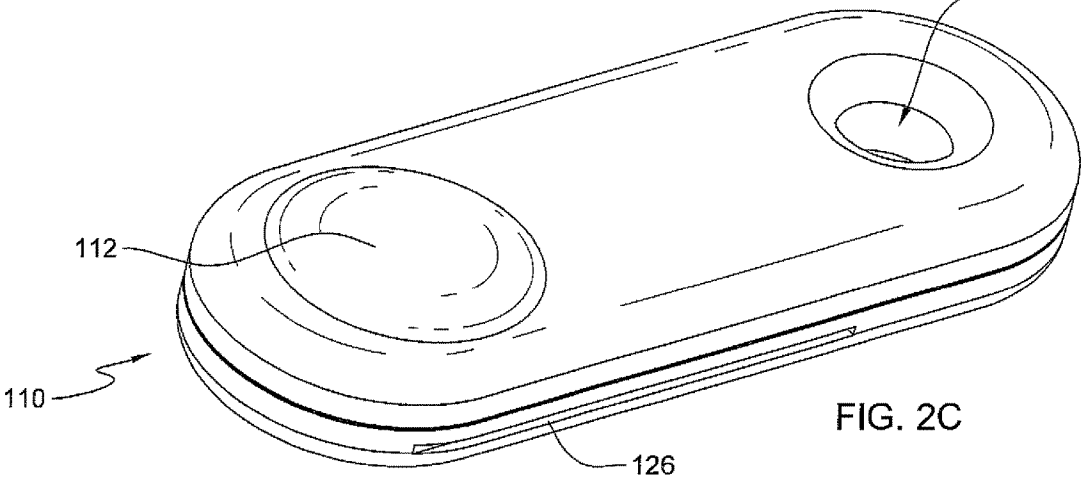

FIG. 2C presents a side perspective view of the wearable ringer to highlight grooves 126 therein. The grooves 126 are configured to receive tongues or flanges 134 of the wearable ringer bracket 132, interconnecting the two parts. A latch mechanism 136 is part of the wearable ringer bracket 132, for latching the wearable ringer 110 to the bracket 132. That is, the wearable ringer 110 is slid in a way that the grooves 126 receive the tongues 134 (as the ringer 110 slides onto the bracket 132), up to a point where the latch 136 latches and holds the ringer and bracket together. Pressing the latch mechanism 136 releases the wearable ringer 110 from the wearable ringer bracket 132.

Figure 3B:
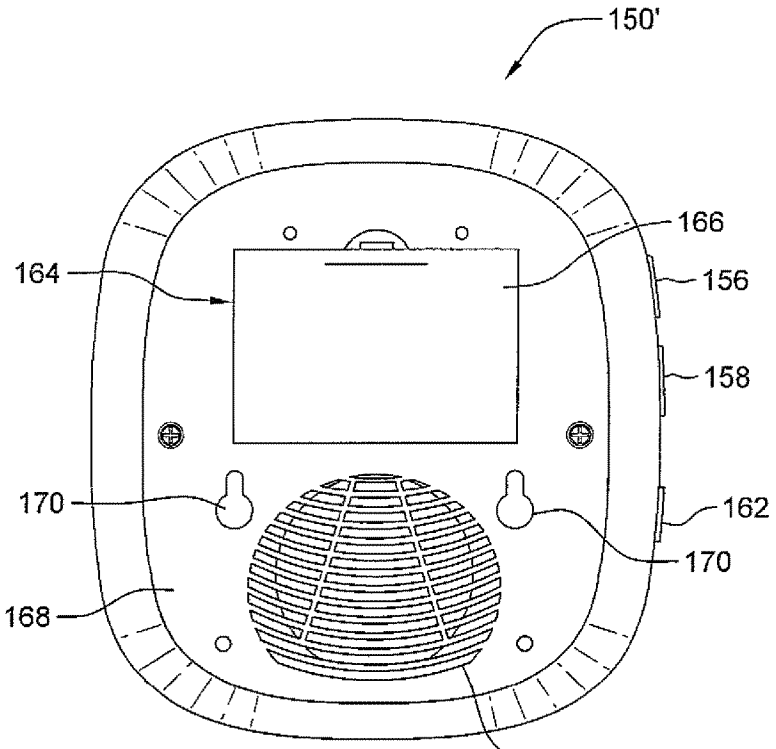
FIG. 3B depicts a back view of a battery (DC) powered embodiment of a wireless doorbell receiver of the inventive wireless doorbell set.
Figure 3A:
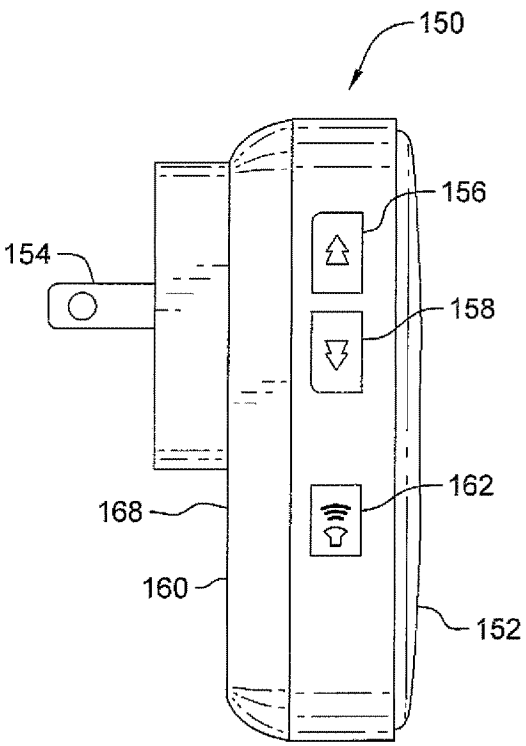
FIG. 3A depicts a side view of an AC-powered embodiment of a wireless doorbell receiver of the inventive wireless doorbell set.

The wireless doorbell receiver 150 is seen in FIG. 3A in a side view, to highlight various features. For example, the wireless doorbell receiver as shown is an AC-powered wireless doorbell receiver and includes an AC plug 154. A music forward button 156, and a music backward button 158 are included to allow a user to control the sound emitted from a speaker 160. A volume control button 162 is included to control the volume.

FIG. 3B depicts a battery-powered embodiment of a wireless doorbell receiver 150'. Wireless doorbell receiver 150' includes a battery compartment 164, that contains 3 1.5 V AAA batteries (not shown), under a battery compartment cover 166. The wireless doorbell receiver 150' includes back surfaces embodying removable plate 168. The "back" removable plate 168 includes openings 170 through which attaching means, such as screws (not shown) may be passed to attach the "back" removable plate to a wall or the like, whereinafter the remainder of the wireless doorbell receiver 150' is attached to the plate. Please note, however, that while the wireless doorbell receiver 150 includes a removable back plate 168, the receiver does not need to be fixed to a wall. Receiver 150, for example, can be positioned in an AC source receptacle (not shown).

The wireless doorbell receiver 150 is configured to receive a wireless signal generated by the wearable ringer 110 and to generate a sound, or a light signal, or both, in response thereto. The wireless doorbell receiver 150 includes a circular lens 152, through which light is emitted in response to receipt of a wireless signal (i.e., a ring signal) from upon the wearable ringer 110. As already explained, the wireless signal is generated by the wearable ringer 100 in response to a user pressing the ringer actuator 112.

FIG. 4A presents a back view of the wearable wireless ringer 110 depicted in FIGS. 1, 2A and 2B, with the wearable ringer bracket 132 removed. As is seen in FIG. 4A, screws 117 are included to screw the back-side plate 116 to the remainder of the wearable wireless ringer housing.

FIG. 4B highlights the removable lanyard ring mechanism 180, which is removably attached to the wearable wireless ringer 110 via through-hole 113 by a loop or fastener 182. The loop or fastener 182 connects to a body part 184, which is connected to a ring part 186. The ring part 186 is detachably connected to a lanyard mechanism 190. The lanyard mechanism 190, depicted in FIG. 4C, includes a press-button connector mechanism 192, that snaps into the ring part 186 of the removable lanyard ring mechanism 186. A disconnect button 194 is part of the press-button connector mechanism 192. The disconnect button 194 is pressed to disconnect the lanyard mechanism 190 from the removable lanyard ring mechanism 180. The press-button connector mechanism 192 is attached by a connector 196 to a lanyard 198.

FIG. 5A presents a front view of the wearable ringer part 110, with the wearable ringer bracket 132 and the front side plate 114 removed. Also removed (as shown) is a battery 117 that is positioned in a part 119 of the ringer part 110. Also shown is the responsive part 112A of ringer actuator 112 and an antenna 121. FIG. 5B presents a front-side view of the wearable ringer 110, to highlight the button part 112B as shown.

Attaching the wearable ringer 110 to the removable lanyard ring 180 and lanyard connection mechanism 190 (together "the lanyard") enables a user to wear the lanyard and the wearable ringer about the his/her neck and actuate the push button actuator 112 to cause the ringer to send a signal that is received by and triggers the wireless doorbell receiver 150 to generate a sound and/or light signal, when the wearable ringer is in a receiving range of the wireless doorbell receiver. The wearable ringer bracket 132, when detached from the back side of the wearable ringer 110, is mounted at a position within a receiving range of the receiver 150. The wearable ringer 110 may be attached to the wearable ringer bracket 132 at the mounted position, such that a user may actuate the push-button actuator 112 to cause the wireless doorbell receiver to generate a sound.

The wearable ringer 110 housing, the wireless doorbell receiver 150 housing and the wearable ringer bracket 132 are made of plastic, for example, polyvinyl chloride, or acrylonitrile butadiene styrene (ABS) thermoplastic, but are not limited thereto. The wearable ringer 110, aside from the structural elements described above, further comprises an antenna, button battery, a PCB board comprising electronic components including at least one integrated circuit, at least one filter, an LED, at least one triode, a touch switch and a crystal. The wireless doorbell receiver 150, aside from the structural elements described above, further comprises a power connector, a speaker, a transformed, a touch switch, an antenna, a PCB board comprising electronic components including at least one integrated circuit, at least one music integrated circuit, at least one chip diodes, at least one triode, at least one rectifier diode, touch switches and an LED. The touch switches control the sound volume and a musical selection for the sound. Preferably, the wireless doorbell receiver further comprises a battery and a battery cover to allow access to the battery.

The wireless doorbell set may be operated as an alert system, where the user may maintain the wireless wearable ringer on their person, i.e., on the lanyard about the user's neck or even in the user's hand, so to enable the user to press the actuator button any time the user wishes to bring attention to his/herself. Of course, the user may at any time connected the ringer to a mounted bracket and slide the ringer thereon. The bracket may be mounted outside the house, for example, where a traditional doorbell might be found, or in the inside of a house or structure, to meet all possible needs. The volume of the sound emitted from the receiver in response to a ring signal may be adjusted to affect the effectiveness of the notification by the doorbell set.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A wireless doorbell set, comprising:

a wearable ringer comprising a ringer housing formed with a front, a back, a top, a bottom, a left and a right side;

a push button actuator positioned on the front side of the ringer housing that when pushed by a user generates a wireless ring signal;

a wireless doorbell receiver that is configured for mounting on a wall or like structure and to receive the wireless ring signal generated by the wearable ringer and to generate a sound signal, a light signal or both in response to receiving the wireless ring signal; and a wearable ringer bracket that is configured to receive the wearable ringer; and a lanyard that is configured to be attachable to and detachable from the wearable ringer;

wherein the wearable ringer is configured to be maintained in the wearable ringer bracket and configured to be attached to the lanyard so the wearable ringer may be carried instead of positioned in the wearable ringer bracket; and wherein the wearable ringer housing includes substantially parallel grooves arranged along the left and right sides, proximate to the back side, and substantially arranged in parallel to a planar surface of the back side.

2. The wireless doorbell set as in claim 1, wherein the ringer housing comprises two separable parts that snap together to form the housing.

3. The wireless doorbell set as in claim 1, wherein attaching the wearable ringer to the lanyard enables a user to wear the lanyard and wearable ringer about the user's neck and actuate the push button actuator to cause the wireless doorbell receiver to generate the sound, the light signal or both when the wearable ringer is in a receiving range of the wireless doorbell receiver.

4. The wireless doorbell set as in claim 3, wherein attaching the wearable ringer to the wearable ringer bracket enables the user to wear the lanyard and wearable ringer with the wearable ringer bracket attached thereto about the user's neck.

5. The wireless doorbell set as in claim 1, wherein the wearable ringer bracket, when detached from the wearable ringer, is mounted at a stationery position within a receiving range of the receiver.

6. The wireless doorbell set as in claim 5, wherein the wearable ringer is attached to the wearable ringer bracket at the mounted stationery position, whereby a user may actuate the push button actuator to cause the wireless doorbell receiver to generate the sound, light signal or both.

7. The wireless doorbell set as defined by claim 1, wherein the wearable ringer bracket is configured with opposing side flanges that slide into and out of the corresponding grooves on the wearable ringer, to attach the wearable ringer to and detach the wearable ringer from the wearable ringer bracket.

8. The wireless doorbell set as defined by claim 7, wherein the wearable ringer bracket includes a latching mechanism that latches the wearable ringer when the wearable ringer is slid into the wearable ringer bracket to a latching position.

9. The wireless doorbell set as defined by claim 8, wherein the latching mechanism includes a release button for unlatching the wearable ringer from its latched position with the wearable ringer bracket.

10. The wireless doorbell set as defined by claim 1, wherein the wearable ringer housing includes an opening that extends completely through the wearable ringer, from the front side through to the back side and wherein the lanyard is attachable to and detachable from the wearable ringer via the opening.

11. The wireless doorbell set as defined by claim 10, wherein the opening is arranged proximate one end of the wearable ringer housing and the push button actuator is arranged on an opposing end of the wearable ringer housing.

12. The wireless doorbell set of claim 1, wherein the wearable ringer further comprises an antenna from which the wireless ring signal is transmitted, button battery that provides power to the wearable ringer, a PCB board comprising electronic components including at least one integrated circuit, at least one filter, an LED, at least one triode, a touch switch and a crystal, which electronic components enable wireless ringer operation.

13. The wireless doorbell set of claim 12, wherein the wireless doorbell receiver further comprises a power connector that enables the wearable receiver to be connected to a source of alternating current (AC) power, a speaker that outputs a sound in response to the sound signal, a transformer for transforming the AC power to direct current (DC) power, a touch switch for controlling a sound volume, an antenna for receiving the wireless ring signal from the wearable ringer, a PCB board comprising electronic components including at least one integrated circuit, at least one music integrated circuit, at least one chip diodes, at least one triode, at least one rectifier diode, touch switch and an LED, which electronic components enable wireless doorbell receiver operation.

14. The wireless doorbell set of claim 12, wherein the touch switch also controls the sound volume and a musical selection for the sound.

15. The wireless doorbell set of claim 12, wherein the wireless doorbell receiver further comprises a battery and a battery cover to allow access to the battery.

* * * * *